US008847847B2

(12) United States Patent
Tu

(10) Patent No.: US 8,847,847 B2
(45) Date of Patent: Sep. 30, 2014

(54) DUAL FREQUENCY ANTENNA MODULE

(71) Applicant: Hon Hai Precision Industry Co., Ltd., New Taipei (TW)

(72) Inventor: Hsin-Lung Tu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 125 days.

(21) Appl. No.: 13/626,854

(22) Filed: Sep. 25, 2012

(65) Prior Publication Data

US 2014/0049445 A1 Feb. 20, 2014

(30) Foreign Application Priority Data

Aug. 20, 2012 (TW) ..... 101130178 A

(51) Int. Cl.
*H01Q 1/36* (2006.01)
*H01Q 1/38* (2006.01)

(52) U.S. Cl.
USPC ..... 343/895; 343/700 MS

(58) Field of Classification Search
CPC ..... H01Q 1/38; H01Q 5/0034; H01Q 5/0024; H01Q 9/26
USPC ..... 343/700 MS, 895
See application file for complete search history.

(56) References Cited

U.S. PATENT DOCUMENTS 8,373,602 B2 * 2/2013 Hsu ..... 343/702
8,659,482 B2 * 2/2014 Kim et al. ..... 343/700 MS
2012/0287012 A1 * 11/2012 Aizawa ..... 343/853

* cited by examiner

*Primary Examiner* — Hoang V Nguyen
(74) *Attorney, Agent, or Firm* — Novak Druce Connolly Bove + Quigg LLP

(57) ABSTRACT

A dual frequency antenna module is disposed on a substrate. The substrate includes a first surface and a second surface. The dual frequency antenna module includes a first antenna, a second antenna, a first connecting portion, and a second connecting portion. The antennas are in symmetry about a central line of the antenna module and disposed on the first surface. Each antenna includes a radiation portion and a feeding portion. The connecting portions are disposed on the first surface and connected to each other in symmetry. A width of each microstrip transmission line of the connecting portions is less than a width of each microstrip transmission line of the antennas. A wavelength of electromagnetic waves transmissible through the microstrip transmission lines of the connecting portions is equal to one half of a wavelength of electromagnetic waves transmissible through the microstrip transmission lines of the first and second antennas.

7 Claims, 5 Drawing Sheets

DUAL FREQUENCY ANTENNA MODULE

BACKGROUND

1. Technical Field

The disclosure relates to wireless communication, and particularly to a dual frequency antenna module.

2. Description of Related Art

Dual frequency technology is achieving significant growth due to the ever growing demand for wireless communication products. Dual frequency antennas are widely used in the field of wireless communication. Generally, a dual frequency antenna includes at least two individual antennas. Each antenna needs to be designed as small as possible but the space and radiation requirements of wireless local area network (WLAN) devices employing the antennas imposes strict design conditions concerning isolation between the antennas.

Therefore, what is needed is a dual frequency antenna module to overcome the described shortcoming.

DETAILED DESCRIPTION

Figure 1:
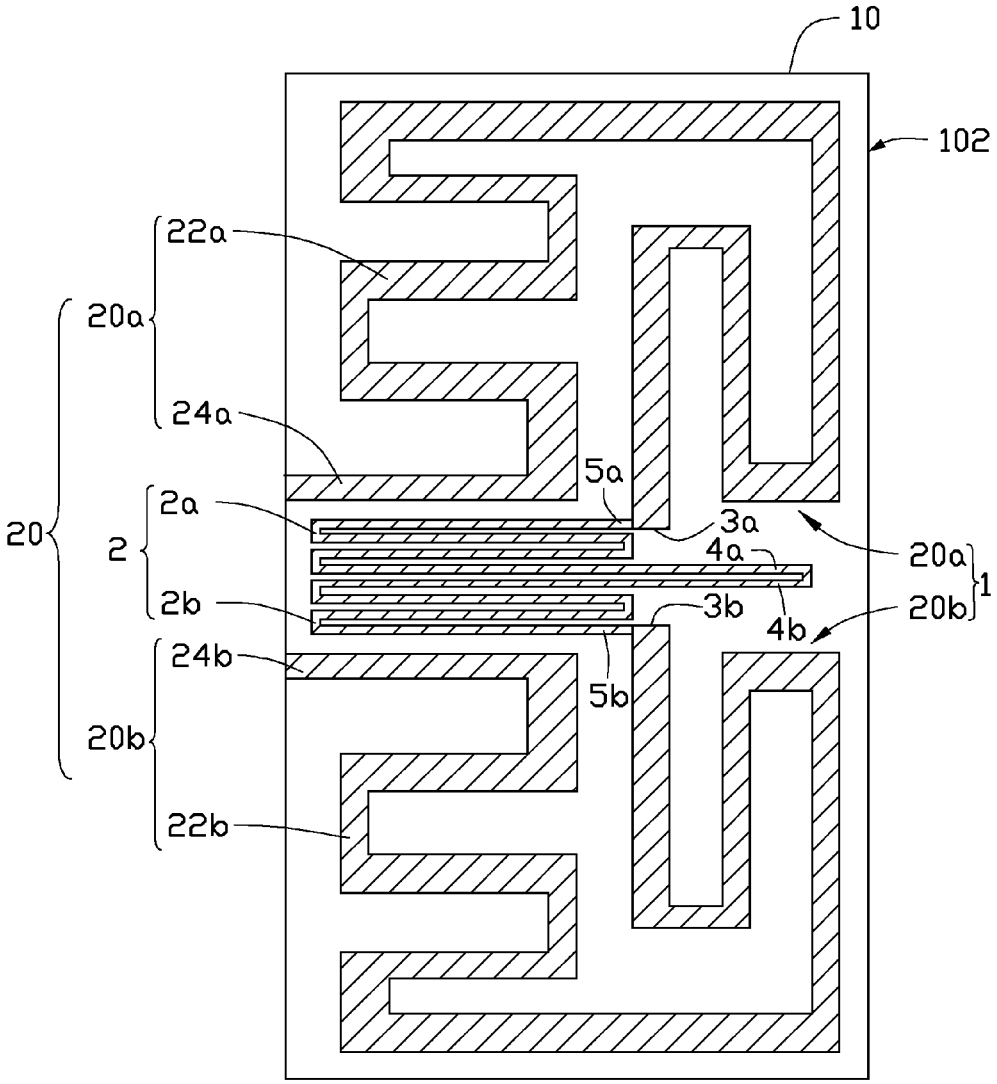
FIG. 1 is a front view schematic diagram of a dual frequency antenna module in accordance with an embodiment of the invention.

FIG. 1 is a front view of a dual frequency antenna module 20 in accordance with an embodiment.

In this embodiment, the dual frequency antenna module 20 is disposed on a substrate 10. The substrate 10 is a printed circuit board (PCB) and includes a first surface 102 and a second surface (not shown) opposite to the first surface 102. The dual frequency antenna module 20 is made up of copper clad laminate (CCL) medium material. The dual frequency antenna module 20 includes an antenna zone 1 and a connecting zone 2. The antenna zone 1 includes at least a first antenna 20*a* and a second antenna 20*b*. The first antenna 20*a* and the second antenna 20*b* are symmetrical about a central line of the dual frequency antenna module 20. The connecting zone 2 is between the first antenna 20*a* and the second antenna 20*b* and is connected to both.

The first antenna 20*a* includes a radiation portion 22*a*, a feeding portion 24*a*, and a grounding layer (not shown). The second antenna 20*b* similarly includes a radiation portion 22*b*, a feeding portion 24*b*, and the grounding layer.

The radiation bodies 22*a*, 22*b* are disposed on the first surface 102, for transmitting and receiving electromagnetic signals. The radiation bodies 22*a*, 22*b* are serpentine-shaped and each includes a number of microstrip transmission lines which includes first microstrip transmission lines oriented in a first direction and second microstrip transmission lines oriented in a second direction perpendicular to the first microstrip transmission lines. The first and second microstrip transmission lines are connected to each other in an alternate fashion. A width of each first microstrip transmission line is not equal to a width of the neighboring second microstrip transmission line. In the embodiment, the number of microstrip transmission lines are L-shaped. One end of the radiation portion 22*a*/22*b* is connected to the feeding portion 24*a*/24*b* and the other end is connected to the connecting zone 2.

In this embodiment, the radiation portion 22*a*/22*b* includes seven pieces of L-shaped microstrip transmission lines and a width of each piece of L-shaped microstrip transmission line lengthways along the substrate 10 is different from a width of the L-shaped microstrip transmission line crosswise.

An open end 3*a* of the first antenna 20*a* is disposed adjacent to an open end 3*b* of the second antenna 20*b*. The feeding portions 24*a*/24*b* are disposed on the first surface 102, and electronically connected to the radiation bodies 22*a*/22*b* and the grounding layer of the first, second antenna 20*a*/20*b*. The feeding portions 24*a*/24*b* are used for feeding electromagnetic signals to the radiation bodies 22*a*/22*b*. The grounding layer of the first antenna 20*a* and the second antenna 20*b* is disposed on the second surface.

The connecting zone 2 includes a first connecting portion 2*a* and a second connecting portion 2*b*. The first connecting portion 2*a* and the second connecting portion 2*b* are disposed on the first surface 102 and connected to each other. The first connecting portion 2*a* and the second connecting portion 2*b* are also symmetrical about the central line. The first connecting portion 2*a* is connected to the open end 3*a* of the radiation portion 22*a* of the first antenna 20*a*. The second connecting portion 2*b* is connected to the open end 3*b* of the radiation portion 22*b* of the second antenna 20*b*. In the embodiment, the first connecting portion 2*a* has the same shape as the shape of the second connecting portion 2*b*.

The first connecting portion 2*a* includes a long microstrip transmission line 4*a* and several short microstrip transmission lines 5*a* parallel to the long microstrip transmission line 4*a* which are arranged in a concertinaed fashion. The second connecting portion 2*b* similarly includes a long microstrip transmission line 4*b* and several short microstrip transmission lines 5*b* parallel to the long microstrip transmission line 4*b* which are arranged in a concertinaed fashion. The number of the microstrip transmission lines of each of the radiation bodies 22*a*, 22*b* is greater than the number of the microstrip transmission lines of each of the connecting portions 2*a*, 2*b*.

A length of the long microstrip transmission line 4*a* is equal to one and a half times the length of the short microstrip transmission line 5*a*. A length of the long microstrip transmission line 4*b* is equal to one and a half times the length of the short microstrip transmission line 5*b*. A width of the microstrip transmission line of the first connecting portion 2*a* is less than a width of the microstrip transmission line of the radiation portion 22*a*/22*b*. A width of the microstrip transmission line of the second connecting portion 2*b* is less than the width of the microstrip transmission line of the radiation portion 22*a*/22*b*. In this way, the isolation between the first antenna 20*a* and the second antenna 20*b* is improved.

In this embodiment, a wavelength of electromagnetic waves transmissible through the microstrip transmission lines of the connecting zone 2 is equal to one half of a wavelength of electromagnetic waves transmissible through the microstrip transmission lines of the antenna zone 1 and an impedance ratio of the microstrip transmission lines of the connecting zone 2 to the antenna zone 1 is equal to 1:3. A radiation field produced by a coupling effect of the first, second radiation bodies 22*a*, 22*b* improves the radiation efficiency of the dual frequency antenna module 20. In other words, the first, second radiation bodies 22*a* and 22*b* reduce the surface area of the dual frequency antenna module 20, and improve the radiation efficiency of the dual frequency antenna module 20. In this embodiment, the radiation bodies 22*a* and 22*b* have a shape which is selected from a group of consisting of an s-shaped configuration, a w-shaped configuration, and a u-shaped configuration.

Figure 2:
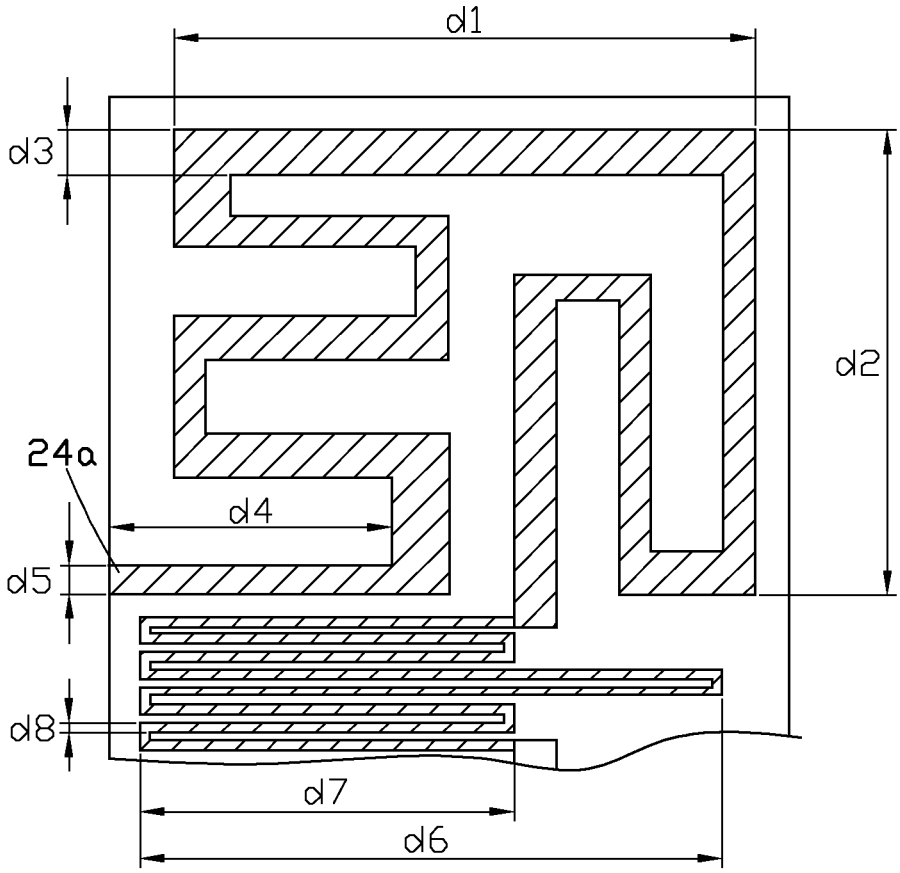
FIG. 2 is a schematic diagram illustrating dimensions of the dual frequency antenna module of FIG. 1.

FIG. 2 illustrates various dimensions of the dual frequency antenna module 20 of FIG. 1.

All dimensions of all parts of the first antenna 20*a* are the same as the corresponding dimensions of the second antenna 20*b* and only the dimensions of the first antenna 20*a* will be explained. A total length d1 of the first radiation portion 22*a* is 8.5 millimeters (mm), and a total width d2 of the first radiation portion 22*a* is 8 mm. The width of each piece of L-shaped microstrip transmission line of the first radiation portion 22*a* in the lengthways direction is 0.8 mm and the width of the transmission line of the first radiation portion 22*a* in the crosswise direction is 0.5 mm. The feeding portion 24*a* is rectangular. A length d4 of the feeding portion 24*a* is 4.2 mm, and a width d5 of the feeding portion 24*a* is 0.5 mm.

All dimensions of all parts of the first connecting portion 2*a* are the same as the corresponding dimensions of the second connecting portion 2*b*. A length d6 of the long microstrip transmission line of the first connecting portion 2*a* is 8.4 mm, a length d7 of the short microstrip transmission line of the first connecting portion 2*a* is 5.6 mm, and the width d8 of the long, short microstrip transmission line of the first connecting portion 2*a* is 0.1 mm.

Figure 3:
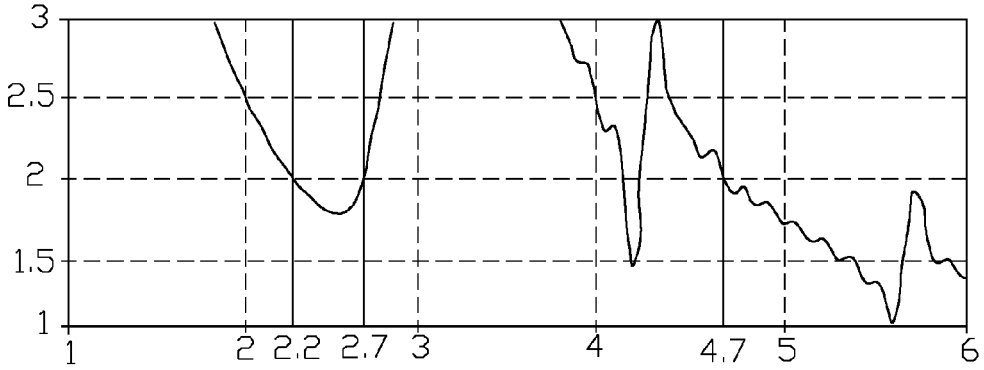
FIG. 3 is a graph of test results showing voltage standing wave ratios (VSWRs) of a first antenna of the dual frequency antenna module of FIG. 1.

FIG. 3 is a graph of test results showing voltage standing wave ratios (VSWRs) of the first antenna 20*a* of the dual frequency antenna module 20 of FIG. 1. The horizontal axis represents the frequency (in GHz) of the electromagnetic signals traveling through the first antenna 20*a*, and the vertical axis represents amplitude of the VSWRs. A curve shows the amplitude of the VSWRs of the first antenna 20*a* at various working frequencies. As shown in FIG. 3, the first antenna 20*a* performs well when working at frequency bands of 2.2-2.7 GHz and 4.7-6.0 GHz. The amplitude values of the VSWRs in the band pass frequency range are less than 2, which indicates that the first antenna 20*a* complies with application requirements of the dual frequency antenna module 20.

Figure 4:
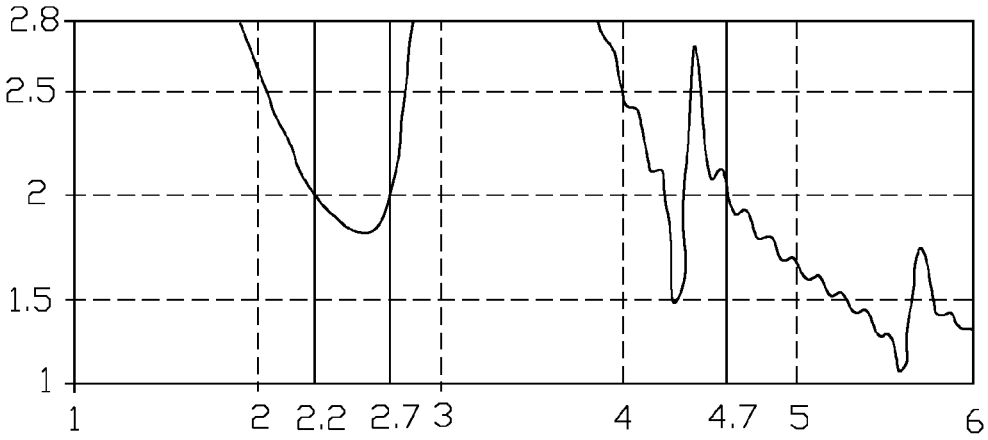
FIG. 4 is a graph of test results showing the VSWRs of a second antenna of the dual frequency antenna module of FIG. 1.

FIG. 4 is a graph of test results showing VSWRs of the second antenna 20*b* of the dual frequency antenna module 20 of FIG. 1. The horizontal axis represents the frequency (in GHz) of the electromagnetic signals traveling through the second antenna 20*b*, and the vertical axis represents amplitude of the VSWRs. A curve shows the amplitude of the VSWRs of the second antenna 20*b* at working frequencies. As shown in FIG. 4, the second antenna 20*b* performs well when working at frequency bands of 2.2-2.7 GHz and 4.7-6.0 GHz. The amplitude values of the VSWRs in the band pass frequency range are less than 2, which indicates that the second antenna 20*b* complies with application requirements of the dual frequency antenna module 20.

Figure 5:
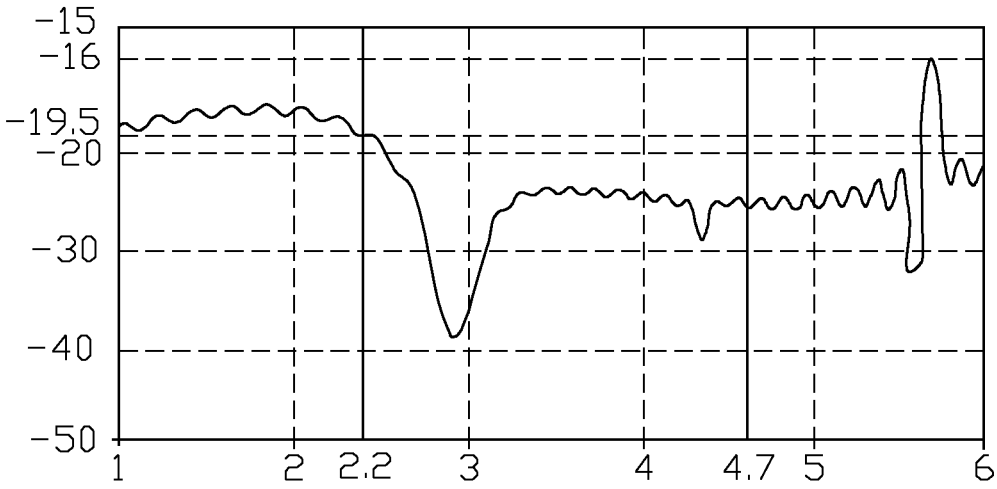
FIG. 5 is a graph of test results showing isolation between the first antenna and the second antenna of the dual frequency antenna module of FIG. 1.

FIG. 5 is a graph of test results showing isolation between the first antenna 20*a* and the second antenna 20*b* of the dual frequency antenna module 20 of FIG. 1. The horizontal axis represents the frequency (in GHz) of the electromagnetic signals traveling through the dual frequency antenna module 20, and the vertical axis represents the amplitude of the isolation. As shown in FIG. 5, a curve shows isolation between the first antenna 20*a* and the second antenna 20*b* is at the greatest −19.5 dB when the dual frequency antenna module 20 works at frequency band of 2.2-2.7 GHz. Isolation between the first antenna 20*a* and the second antenna 20*b* is at the greatest −16 dB when the dual frequency antenna module 20 works at frequency band of 4.7-6.0 GHz. The smallest isolation values of the two bands are less than −10 dB, which indicates that the dual frequency antenna module 20 complies with application requirements of a dual frequency antenna.

In this embodiment, the first radiation portion 22*a* and the second radiation portion 22*b* are serpentine-shaped. Therefore, the compactness of the dual frequency antenna module 20 is optimal. The dual frequency antenna module 20 works in two frequency bands synchronously, such as 2.4 GHz and 5.0 GHz.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A dual frequency antenna module comprising:

a substrate comprising a first surface and an opposite second surface; and a dual frequency antenna comprising: a grounding layer formed on the second surface;

a first antenna;

a second antenna, the first antenna and the second antenna being symmetrical about a central line of the dual frequency antenna, each of the first and second antennas comprising:

a radiation portion configured for transmitting and receiving electromagnetic signals, the radiation portion comprising a plurality of microstrip transmission lines including first microstrip transmission lines oriented in a first direction and second microstrip transmission lines oriented in a second direction perpendicular to the first direction, the first and second microstrip transmission lines connected to each other in an alternate fashion; and a feeding portion connected between the grounding layer and the radiation portion, and configured for feeding electromagnetic signals to the radiation portion;

a first connecting portion; and a second connecting portion, the first and second connecting portions being connected with each other and arranged on the first surface between the radiation portions in symmetry about the central line, each of the first and second connecting portions comprising a plurality of microstrip transmission lines arranged in a concertinaed fashion;

wherein a width of each microstrip transmission line of the first and second connecting portions is less than a width of each microstrip transmission line of the first and second antennas, and a wavelength of electromagnetic waves transmissible through the microstrip transmission lines of the connecting portions is equal to one half of a wavelength of electromagnetic waves transmissible through the microstrip transmission lines of the first and second antennas.

2. The dual frequency antenna as recited in claim 1, wherein a width of each first microstrip transmission line is not equal to a width of the neighboring second microstrip transmission line.

3. The dual frequency antenna as recited in claim 1, wherein the number of the microstrip transmission lines of each radiation portion is greater than the number of the microstrip transmission lines of each of the connecting portions.

4. The dual frequency antenna as recited in claim 1, wherein the first connecting portion is connected to the first antenna and the second connecting portion is connected to the second antenna.

5. The dual frequency antenna as recited in claim 1, wherein each feeding portion perpendicularly extends from the first surface to the second surface.

6. The dual frequency antenna as recited in claim 1, wherein an impedance ratio of each of the first and second connecting portions to each of the first and second antennas is equal to 1:3.

7. The dual frequency antenna as recited in claim 1, wherein the microstrip transmission lines of each of the connecting portions include a long microstrip transmission line and a plurality of short microstrip transmission lines parallel to the long microstrip transmission line, and a length of the long microstrip transmission line is equal to one and a half times a length of each short microstrip transmission line.

* * * * *